US008950224B2

(12) United States Patent
Spencer

(10) Patent No.: US 8,950,224 B2
(45) Date of Patent: Feb. 10, 2015

(54) METHOD AND SYSTEM FOR TEMPORARY STORAGE OF FIREARMS

(71) Applicant: Thomas Spencer, Detroit, MI (US)

(72) Inventor: Thomas Spencer, Detroit, MI (US)

( * ) Notice: Subject to any disclaimer, the term of this patent is extended or adjusted under 35 U.S.C. 154(b) by 0 days.

(21) Appl. No.: 13/922,660

(22) Filed: Jun. 20, 2013

(65) Prior Publication Data

US 2014/0000495 A1 Jan. 2, 2014

Related U.S. Application Data

(60) Provisional application No. 61/666,444, filed on Jun. 29, 2012.

(51) Int. Cl.

| | |
|---|---|
| ***E05B 53/00*** | (2006.01) |
| ***E05G 1/00*** | (2006.01) |
| ***E05G 1/08*** | (2006.01) |

(52) U.S. Cl.

CPC *E05G 1/08* (2013.01); *E05G 1/005* (2013.01); *E05Y 2400/66* (2013.01)

USPC ..... 70/63; 70/266; 70/278.1; 109/57

(58) Field of Classification Search

USPC ..... 70/262–266, 271, 275, 277, 278.1, 280; 109/53, 56, 57

See application file for complete search history.

(56) References Cited

U.S. PATENT DOCUMENTS

| | | | | |
|---|---|---|---|---|
| 5,219,386 | A * | 6/1993 | Kletzmaier et al. | 70/277 |
| 5,504,325 | A * | 4/1996 | Talmon et al. | 250/222.1 |
| 5,946,660 | A | 8/1999 | McCarty | |
| 6,734,783 | B1 * | 5/2004 | Anbai | 340/5.52 |
| 6,961,707 | B2 | 11/2005 | Jenkins | |
| 7,497,376 | B2 | 3/2009 | Landwirth | |
| 7,728,711 | B2 * | 6/2010 | Shoenfeld | 340/5.73 |
| 8,534,207 | B2 * | 9/2013 | Villiger | 109/57 |
| 2001/0032118 | A1 * | 10/2001 | Carter | 705/11 |

* cited by examiner

*Primary Examiner* — Christopher Boswell

(74) *Attorney, Agent, or Firm* — Daniel Boudwin; Global Intellectual Property Agency LLC

(57) ABSTRACT

Provided is a temporary secure storage system for firearms. The system is designed to provide convenient, secure storage of handguns. A number of storage containers employing electronic locking mechanisms are stored within a secure facility. Customers can rent a storage container for a predetermined period of time, during which firearms and accoutrement are kept within an individually locked container. Biometric scanners, card readers, and PIN keypads are examples of the types of authenticators used on each storage container to ensure that only the owner gains access to the contents. The system is ideally suited for persons who lawfully carry concealed weapons and seek to abide by local ordinances regarding gun-free areas. In this manner the system provides convenience and peace of mind to gun-carrying persons.

14 Claims, 5 Drawing Sheets

METHOD AND SYSTEM FOR TEMPORARY STORAGE OF FIREARMS

CROSS REFERENCE TO RELATED APPLICATION

This application claims the benefit of U.S. Provisional Application No. 61/666,444 filed on Jun. 29, 2012, entitled "Temporary Storage." The patent application identified above is incorporated here by reference in its entirety to provide continuity of disclosure.

BACKGROUND OF THE INVENTION

1. Field of the Invention

The present invention relates to a temporary secure storage system. More specifically, the present invention relates to a system and method for storing a large number of handguns in a secure facility. Lockboxes or other storage containers are provided to patrons, who place a firearm within the box and seal the container using a biometric lock. The container is then placed within the storage facility and retained until the patron returns. Biometric input is supplied by the patron in order to facilitate retrieval of the firearm from the container. In this way, the system provides a temporary storage facility for firearms that can be used by patrons with concealed carry licenses, who need to visit a firearm-free area.

The second amendment of the U.S. Constitution provides that the right of the people to keep and bear arms shall not be infringed. With this provision, American citizens enjoy the ability to own a variety of firearm types, including rifles, handguns, and shotguns. The Federal government may not pace limitations on the public's ability to own firearms, nor can they prohibit the public from carrying the same. However, the Supreme Court of the United States has found limitations on the types of firearms that can be owned by private citizens constitutionally, meaning that bans on assault weapons do not violate the second amendment.

For public safety reasons, the States and their municipalities have placed minor limitations on the places arms may be born. Common examples of such limitations include the prohibition of firearm discharge on public lands or within municipality limits, along with a ban on carrying handguns in public places. Such measures are designed and intended to protect the casual public from exposure to loaded weapons and reduce the likelihood that a "fire fight" will break out on the streets.

Despite the good intentions of legislatures, many gun advocates protest the aforementioned limitations on the type of firearms they can own and the ways the arms can be used. Substantial outcry from law-abiding gun owners and the firearms lobbies has led to debate over whether the right to keep and bear arms has any legal teeth, if owners are relegated to only carrying firearms on their own property, and then only if the property is not within municipality limits.

Many states within the USA now offer concealed carry permit licenses that give the bearer the privilege of carrying a handgun on their person while within municipality limits or on public lands. The requirements for obtaining these permits vary widely from state to state, but they share the common goal of regarding law-abiding citizens and maintaining a registry of those persons who are armed in public.

Despite the freedom that concealed carry permits facilitate, they are not universal pass cards for carrying a firearm. Private businesses are permitted to forbid the concealed carry of firearms on their premises so long as visible signs or placards are displayed at the entrance to the building. Thus, arms bearers are forced to leave their hand gun in their vehicle while in the gun-free establishment. But, what if the gun owner walked, or rode a bicycle to the gun-free zone? The owner is left with no safe place to store the firearm. A temporary, easy-to-use storage facility is needed that ensures that patrons are lawful gun owners/carriers, thereby enabling gun owners to travel around a municipality without fear that they will be prevented from entering certain facilities because of their firearm.

2. Description of the Prior Art

The present invention provides a system and method for securely storing handguns in a storage facility. At least one main server is provided, which may be stored at a centralized facility and connected to servers at several satellite storage facilities. A number of storage containers having electronic lock mechanisms are stored in the satellite facility in a predetermined order. Each electronic lock mechanism is associated with an entry in a container database. This database maintains information about patrons while the patron's firearm is in storage at the facility. Information stored in the database is erased after the firearm is retrieved, thereby preserving the patron's anonymity. The following list of system and devices is composed of prior art deemed relevant to the present disclosure.

A method for implementing and automated vault system is described in Landwirth, U.S. Pat. No 7,497,376. A multiple chambered vault is utilized for the storage of safety deposit boxes of the like. Entry into each chamber is regulated via an identity confirmation system. Examples of identity confirmation systems include magnetic cards, smartchip cards, key pads, and biometric authentication. Confirmation of a user's identity at a first station enables entry into a first chamber. Once in the first chamber the user must confirm their identity using a second authentication system. This second system need not be the same as the first identity confirmation system. Successful authentication enables passage into the second chamber, where the safety deposit boxes are kept. This system facilitates automatic self-authenticating access to temporary storage. Unlike the Landwith system, the present invention only requires authentication for access to the interior content of a safety deposit box. The goal of the storage facility is to preserve the anonymity of its customers, and for this reason, customer identity is maintained only while a safety deposit box is in use. The storage facility itself is secure, but users can not gain access to the box storage area on their own.

Self-serve storage boxes are also described in Jenkins, U.S. Pat. No. 6,961,707. The system is an unmanned self-storage facility with storage units (rooms) in a variety of sizes. Customers can access the facility without needing any key but must provide identity confirmation in order to enter the storage unit area. Cameras and communication devices disposed throughout the facility facilitate monitoring of the customer as well as interaction between same and a remote operator. The operator can assist the user in signing a rental agreement, making payments, purchasing a lock as well as troubleshooting problems with storage units. The present invention differs from Jenkins in that it offers a secured entry area, storage boxes that are not accessible to the customer without the assistance of an operator. Further the locking mechanism of the present invention is incorporated into the storage boxes themselves and is not a post facto accessory.

A similar system is disclosed in McCarty, U.S. Pat. No. 5,946,660. The McCarty system is another unmanned self-service storage facility. It features kiosks at each storage facility location that facilitate interaction between a customer and a remote operator. Many operations can be completed at the kiosk, rather than requiring the presence of a physical operator. Unlike the McCarty invention, the present invention employs storage boxes that require individual identity confirmation. Further, the storage facility of the present invention does not permit users access to the area where storage boxes are maintained. Users may only approach the secure first chamber and then are provided with a storage box for use.

These prior art devices have several known drawbacks. They do not teach a system for providing customers with short term use of safety deposit boxes. Nor do they describe safety deposit boxes that the user can only access after confirming their identity to the container. The present invention overcomes these drawbacks by providing storage boxes that individually confirm a user's identity with each box he or she uses. It substantially diverges in design elements from the prior art and consequently it is clear that there is a need in the art for an improvement to existing secure temporary storage systems. In this regard the instant invention substantially fulfills these needs.

SUMMARY OF THE INVENTION

In view of the foregoing disadvantages inherent in the known types of secure temporary storage facilities now present in the prior art, the present invention provides a new individual storage box identity authentication wherein the same can be utilized for providing convenience for the user when storing handguns.

The present invention is a system that includes one or more temporary storage facilities. The facilities may be linked to a central database or may maintain their own customer information databases on-site. Each facility has a substantial number of portable storage containers large enough to retain handguns in a variety of sizes. Boxes have identifying indicia which may be marked on the box or stored within a computer readable media integrated into the storage container. These storage box identification numbers are maintained within the on-site or off-site database. An organizing structure within the facility interior provides a means for associating each box with a particular physical placement in the facility, making it easy for staff to locate any particular box.

Customers of the facility enter a covered service area such as an enclosed drive-through or walk-in waiting area. At the discretion of the facility operator, the entrance and exit doors to the service area may lock upon entry of a customer. This safety feature prevents would-be robbers from approaching customers and stealing their firearms during transactions. Customers can safely wait for an attendant within their car or in the waiting area, without fear of being assaulted.

The system requires multiple forms of authentication by customers, to ensure compliance with all federal and state firearm regulations. The first confirmation stage occurs when a customer provides an attendant or a card reading machine with a valid concealed carry permit. Information such as the license number, customer name and handgun type and serial number are entered into the database either manually by an attendant or automatically by the card reading machine via a local network. License information may be corroborated via a network such as the Internet with an online database of license holders to ensure that all permits are active and valid at the time of the transaction. Once this authentication is complete, the user is provided with an appropriately sized portable storage container.

Handguns, ammunition, and firearm accessories may be safely stored within the portable storage containers. Customers place these items in the box and then engage the second authentication means. This second authentication is a keypad, biometric reader, or card reader. After placing items in the box and closing the lid, the user then types in a unique pin, presses a thumb to a fingerprint image scanner, or swipes his state issued ID or concealed carry permit through the car reader. The box then locks and is opened upon reentry of the pin, fingerprint, or swiping of the card. The locked box is returned to the attendant who updates the database with the organization structure location of the box and places the box in same location.

Customers may return for their box at any time, thus making the present system ideal for storing firearms on both a short term and long-term basis. Travelers may wish to leave their guns safely locked up while on business trips, so that children do not have access to the weapons while the parent is away. Similarly, concealed carry license holders may wish to store their guns while they go to the park, to a restaurant, or other public area. In this way, the system helps gun carriers obey local ordinances and regulations, respect the wishes of private business owners, and still have the freedom to carry their handguns at will.

It is therefore an object of the present invention to provide a new and improved secure temporary storage system that has all of the advantages of the prior art and none of the disadvantages.

It is therefore an object of the present invention to provide portable storage containers that are individually lockable and keyed to a specific user, such that only the user may access the firearm stored within the box.

Another object of the present invention is to provide a secure entrance area that protects customers from theft and assault during transactions.

Yet another object of the present invention is to provide a firearm storage system that ensures compliance with federal and local regulations by authenticating concealed carry licenses.

Still another object of the present invention is to provide a means for temporarily storing a firearm while in a firearm-free zone.

A further object of the present invention is to provide a temporary firearm storage system that does not maintain long-term records of customer information, thereby protecting the anonymity of local gun carriers.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
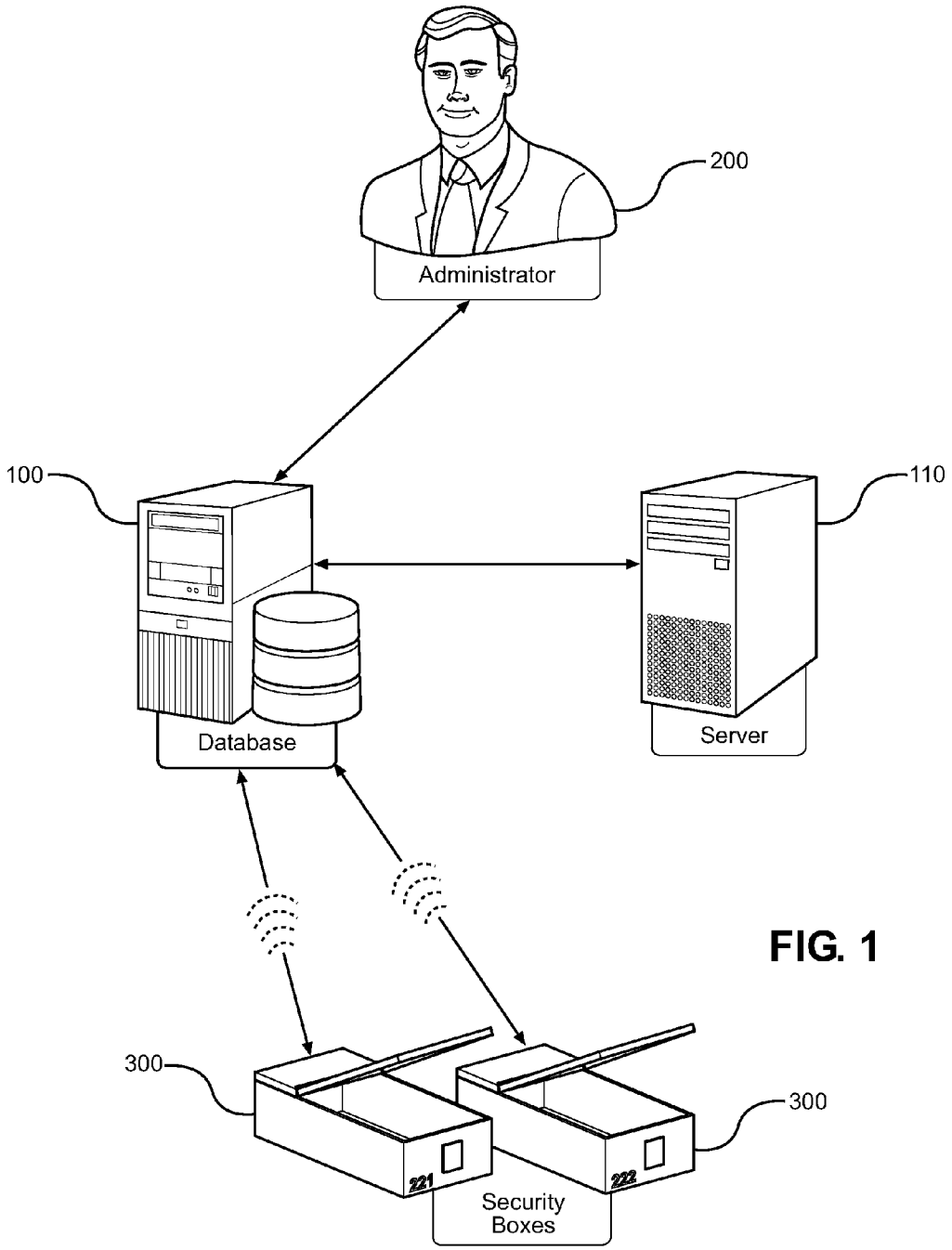
FIG. 1 shows a general system diagram of a basic embodiment of the temporary firearm storage system.

Reference is made herein to the attached drawings. Like reference numerals are used throughout the drawings to depict like or similar elements of the temporary storage system. For the purposes of presenting a brief and clear description of the present invention, the preferred embodiment will be discussed as used of storing handguns. The figures are intended for representative purposes only and should not be considered to be limiting in any respect.

Referring now to FIG. 1, there is shown a basic embodiment of the temporary storage system for firearms. The system contemplates several storage facilities within a single geographical area and many facilities statewide or nationwide. Each facility is an indoor storage area where a multitude of secure storage containers, such as lockboxes are maintained for customers. Customers do not have access to the inner storage area of the facility, but instead access their box through a secure service area such as an enclosed drive through or a walk-in waiting area. While in the service area customers may drop-off or retrieve their handguns pursuant to an identification authentication.

A database 100 stores identifying information of storage container users to ensure that storage containers are properly associated with customers. Administrators 200 or attendants request state issued identification and a municipal concealed carry license from all patrons dropping off handguns. Information displayed on the license and ID is entered into the database along with any identifying information associated with the handgun itself such as serial number, make and model. If the concealed carry permit issuing authority has an online license validation process, the system database may connect over a network with the issuing authority system to validate that the permit is valid and active. Similarly, the state issued ID may be validated over a network via access to an authority such as the state department of motor vehicles. Authentication of ID and permits enables compliance with all federal, state, and municipal gun laws by restricting facility access to only those persons who are authorized to carry the weapon they wish to store.

Portable storage containers 300 are fitted with identification confirmation systems that lock a box upon initial input of a user's information and open the box upon reentry of the same information. The locking mechanism is an electronic lock that receives user input in the form of a keypad, biometric reading, card reading, or the like. In the embodiment shown, the locking mechanism has a wireless communications antenna, or transceiver, for transmitting data to the database. Thus, when the user enters a PIN, or presses their thumb to a scanner, the PIN or thumbprint is sent to the database where it is stored in association with the storage box, until the user comes to retrieve the handgun. The information is stored in an encrypted format and is accessible only to upper level personnel. It is important that general administrators/attendants not be able to access the contents of customer's boxes, but it is also important that law enforcement with valid search warrants have access to box contents in the event that a customer is implicated in a crime involving the handgun in question.

In some cases, the database can also transmit to the storage boxes. For example, if card stripe readers are used as storage box authenticators for controlling the electronic locking mechanism; the desired card information about the card of the customer is transferred to the box from the database. When the customer swipes the ID or permit along the card reader, information read off the card is compared with the transmitted information. A match results in release of the electronic lock, thus only the customer who provided the ID or permit may gain entry into the storage box. This information is retained on a storage media within the electronic locking mechanism, until the card is swiped through the card reader and a second match is made, resulting in the opening of the box for firearm retrieval.

An off-site server 110 is used to link facilities together and can provide backup storage of facility databases if needed. In this way, a home office, or a central administrative facility can monitor usage at different facilities.

Figure 2:
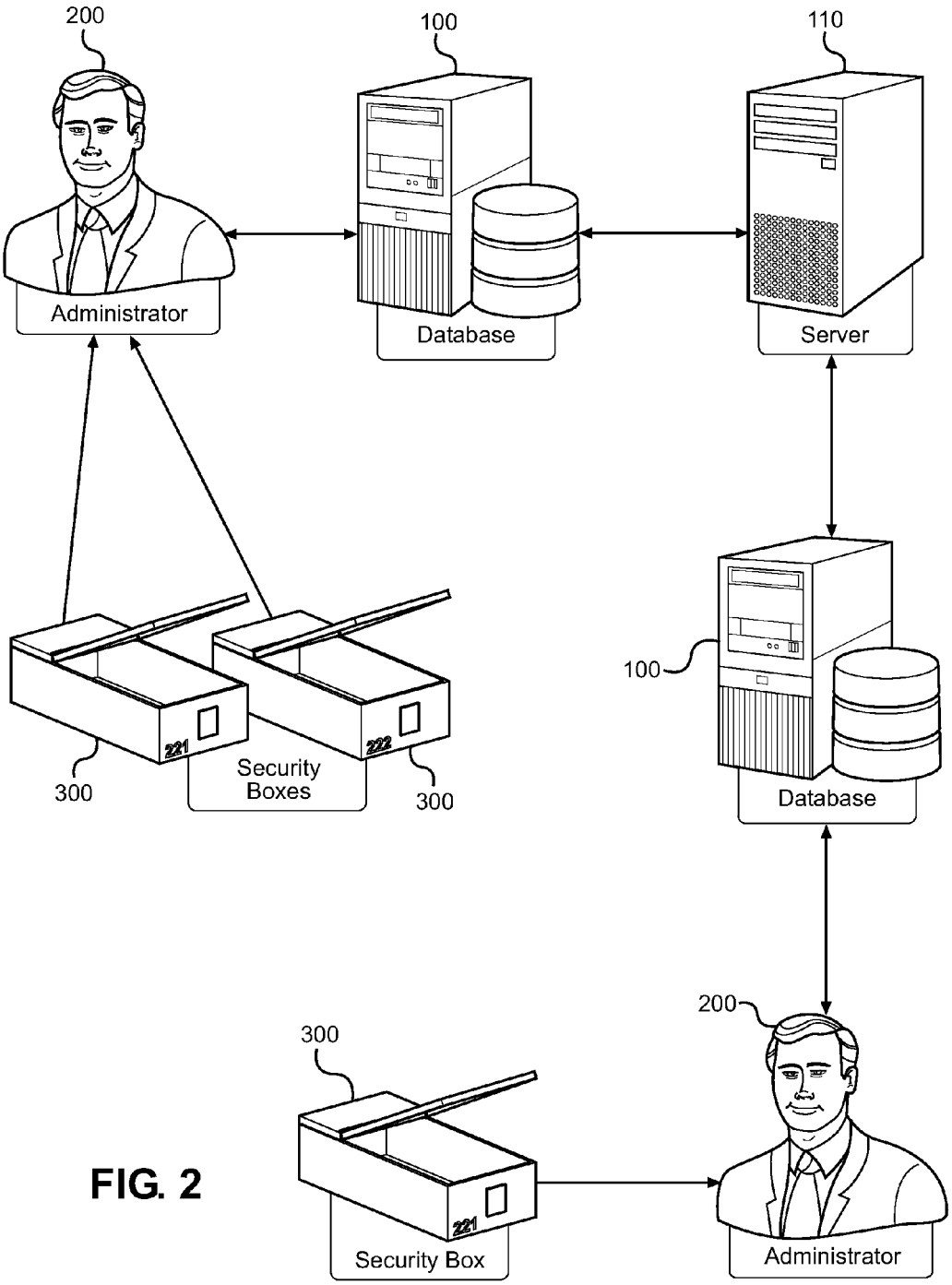
FIG. 2 shows a general system diagram of an expanded embodiment of the temporary firearm storage system.

Referring now to FIG. 2, there is shown an alternative embodiment of the temporary storage system for firearms. In this implementation the storage boxes 300 are not in communication with the database 100. Instead, administrators/attendants 200 must manually enter information into the database if it is to be stored. By way of example, an attendant checks a customer's permits and identification then retrieves a box and gives it to the customer; the customer then opens the box using a first input of personal data, then closes the box and returns it to the attendant, who enters information about the box into the database so that the correct box can be retrieved for the user when they return. The personal information input into the storage box electronic locking mechanism authenticator is temporarily maintained on an internal storage media, but is deleted once the container is successfully reopened/unlocked.

As a further alternative to this embodiment there may be removable storage media that can physically and operably connect with the electronic locking mechanism, so that the personal data can be transferred to the database. Thus, the user inputs his or her personal information into the authenticator and deposits a firearm in the container before returning the box to an attendant; who then removes the storage media and inserts it into the database, prompting automatic transfer of the personal information to a file associated with the customer.

Some identification confirmation means use removably storage media as electronic keys that must be inserted in order to open an electronic lock. This is possible but not preferable with the present invention because the removable storage media are generally small and easily lost, making it risky to leave the electronic key with the customer. It is also undesirable to leave the key with the attendant as this provides attendants with access to the storage box contents, but denies the customer access without first retrieving the key. For these reasons it is important that the authenticator requires the input of personal data from a customer, whether it is in the form of a pin, a card, a thumbprint reader, or the like As in all embodiments of the device, an off-site server 110 may be used to facilitate maintenance and backup of files. Customer entries in the on-site facilities database are deleted after a customer retrieves their firearm, to protect anonymity of patrons. But, it may be preferable that the off-site server is capable of searching facility databases for specific customers in the event that law enforcement with a valid search warrant needs to find the location of a weapon implicated in a crime. Such searches should be limited to specific persons to preserve the anonymity of other patrons; additionally mass printouts of customer information should be disabled.

Figure 3:
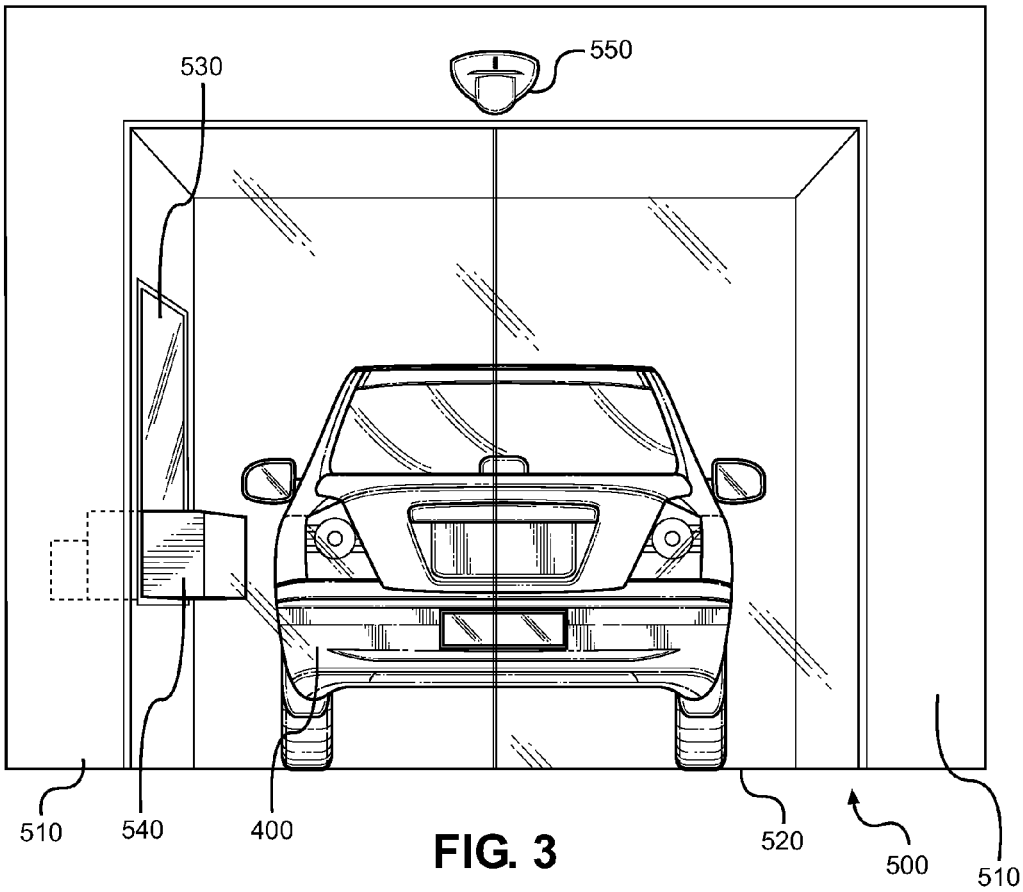
FIG. 3 shows a rear view of a vehicular user within the secure service area.

Turning now to FIG. 3, there is shown an exemplary implementation of a vehicular customer using the secure drive-through service area. The service area 500 is formed from a tunnel 510 extending from the main building and having retractable, locking doors 520 at the entrance and exit therefrom. A motion detection unit 550 identifies a car 400 approaching the service area and signals retraction of the entrance doors. The car then drives forward into the service area and the doors close behind the vehicle, preferably locking. A service window 530 and sliding drawer 540 provide attendants with a way to interact with customers without fear of personal injury from muggers. Storage boxes are placed within the sliding drawer and pass between the customer and attendant. Other transfer means are also available such as vacuum tubes, but the sliding drawer is described herein as an example configuration.

Proper securement of the doors in front of and behind the vehicle in the service area is important to ensure safety of customers during transactions. If the doors are left open, thieves and muggers can approach the car and forcefully take firearms from patrons. Therefore the doors should lock and close after a customer enters the service area, and should be released via the attendant or customer via a button, after the transaction is completed. A similar configuration is desirable in the waiting room style service area for walk-in customers. In either embodiment, there should be an interior release button so that users can exit easily.

Figure 4:
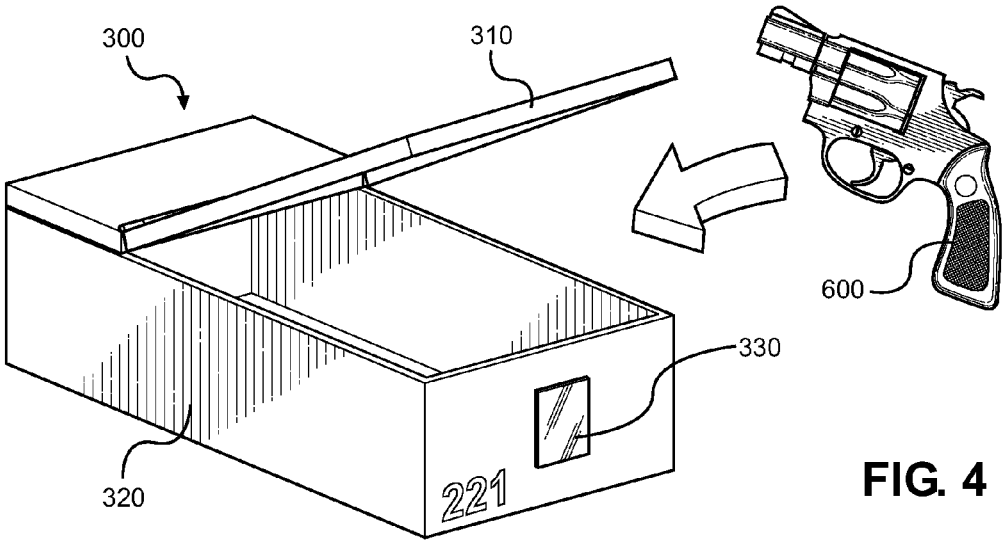
FIG. 4 shows a perspective view of a handgun being deposited into an exemplary storage container.

An illustrative depiction of a storage container used in the present firearm storage system is shown in FIG. 4. Each storage container 300 is a box 320 with a lid 310 that can be lifted or removed to expose an interior volume. This interior volume should be lined with foam, or pillow-type cushioning to protecting the finish of firearms stored within the container. Firearms 600 placed within the container will slide around during transit, making the interior volume padding useful in reducing noise and protecting the firearm from damage and surface scratches. Because the storage container may be used to store live ammunition, it should be fire retardant and thermally insulating to reduce the risk of explosion.

In the depicted example, the authentication means 330 is a biometric thumbprint reader. Only the scanning surface is exposed to the user to protect internal components of the electronic locking mechanism. To lock the box, the user places his or her thumb on the scanning surface. An image of the thumbprint is taken and stored on an internal storage media, for later authentication purposes. A second scanning of the user's thumbprint will re-open the container, permitting access to the firearm stored therein. To accomplish the herein described functions, the storage containers should have at least a storage media, a digital processor, a memory, a battery, an input means, and preferably an external power connection jack for charging the battery.

It is not desired to limit the storage container to a particular size, shape or build. The system may be implemented with storage boxes of a variety of sizes, and employing different types of authenticators. It should be understood that electronic locks are known in the art and it will be apparent to one of ordinary skill how to make storage containers such as those described herein. The goal of the invention is to present a system for temporarily storing firearms, and not to limit implementation to a single configuration or type of hardware.

Figure 5:
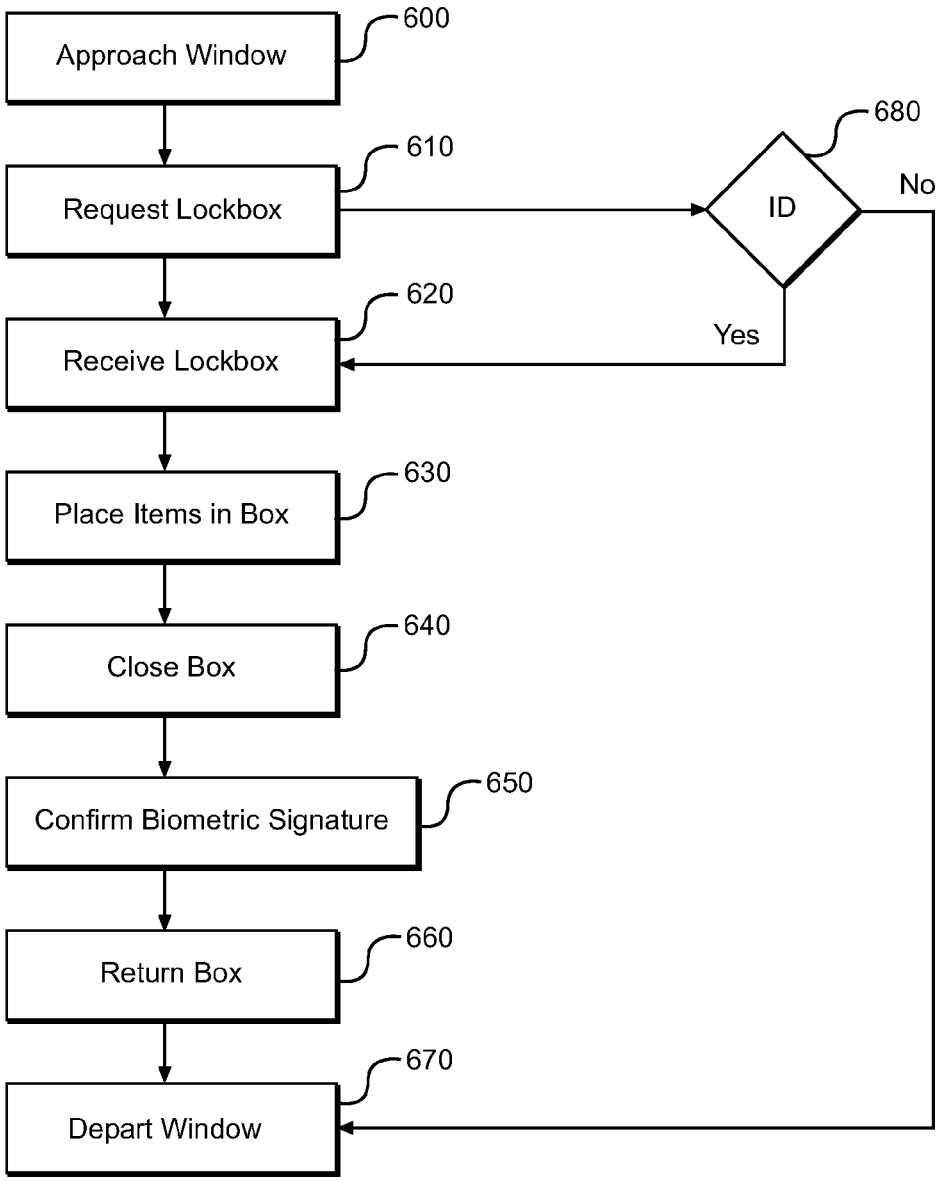
FIG. 5 shows a flow chart of the initial phase of using the system.

A method of using the present system is shown in the flowchart of FIG. 5. When a user approaches the service window via the secure service area 600, he or she requests a lockbox 610 for a handgun or other firearm. An attendant will then prompt the customer to provide an identification card and firearm carrying permit. If the permits are valid and accurate, the attendant provides the customer with a storage container 620. If the customer lacks the appropriate identification they will be asked to depart 670 and return with proper documents Once the customer's identity and firearm permits are confirmed, the customer is given a storage container. A firearm such as a handgun and any related accessories are placed within the padded interior of the storage container 630 and the box is closed 640. The user inputs personal information such as a thumbprint scan or other biometric data 650 causing the box to lock. After the storage container is locked, it is returned to the attendant 660. The customer is then free to depart 670 the secure service area.

The facility is climate controlled and has controlled entry into and exit from the building. Because live ammunition and loaded firearms are stored on the premises, climate control is important for reducing the risk of explosion and fires. Further safety measures are added by providing secure entry into the facility. By way of example, attendants and administrators must use a swipe card or keypad authentication to open facility doors, thereby reducing the likelihood of robberies.

The amount of time a firearm can be stored for may be determined by the system administrator or may vary. Restrictions on time, such as two weeks may be set by the administrator to ensure ample availability of storage containers for short term customers. Alternatively, customers may be able to buy time in predetermined blocks i.e., one hour, five hours, one day, two days, etc. Customers will provide the attendant with information regarding the duration of storage needed at the time of firearm deposit.

Figure 6:
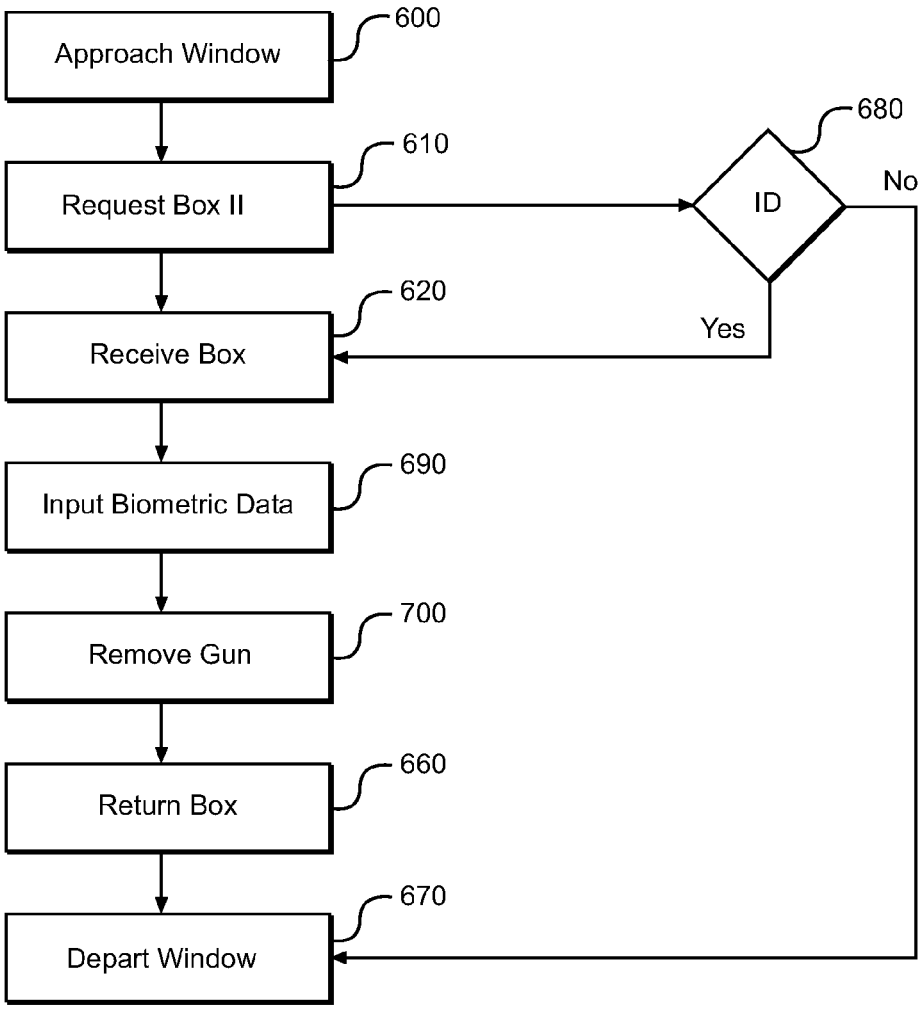
FIG. 6 shows a flow chart of the retrieval phase of the method of using the system.

Referring now to FIG. 6 there is shown a flowchart of the method of retrieving a firearm from storage. The returning customer approaches the secured service area and the service window 600, and then requests his or her storage container 610. If the customer remembers the number of the box this information is conveyed to the attendant. The attendant requests identification from the customer b680 which may be simply picture ID for confirmation purposes. Information on the ID card is compared with database entries by the attendant, so as to confirm that the requester is a patron and lookup what storage container they rented. If the patron has no identifying documents or there is no match in the database, then they will be asked to depart 670 and return with them.

Upon confirmation of a customer's identity they are provided with their storage container 620. In the illustrative example of FIG. 3, the storage container is placed within the sliding drawer, and the drawer pushed forward, providing the vehicular user access to the contents of the drawer and thusly, their storage container. Similarly, a window with a protective door and other types of one-at-a-time access windows may be used.

After the customer has received the box, they input the same personal information into the authenticator 690 that they used when locking the box. If the input means is a biometric scanner, then the user places his or her thumb on the scanner panel for scanning. If the electronic locking mechanism compares the scanned print with the stored print to determine if there is a match. If no match is found the storage container remains locked. If so desired, an audible feedback may be played to indicate that the scanned print does not match the stored print. If the locking mechanism confirms a match between the scanned print and the stored print, the physical lock is released, permitting access to the interior volume of the storage container. Use of card readers and keypads as authenticators is also contemplated and similar comparisons are made between the card information or key number entered into these input means and the stored input to confirm a match.

Customers can retrieve their firearm and accoutrement from the opened storage container 700 before returning it to an attendant 660. The customer is then free to depart 570 the secure service area. Because the service area exit and entryways are locked except when in use, it is desirable that a button is disposed within the service area and initiates disengagement of the electronic door locks.

The storage container remains unlocked until the next customer provides input. To prevent boxes from accidentally locking when an attendant brushes by the scanner panel or keypad, it is desirable that a "begin" button or other input means is provided. When a customer is ready to begin input into the authenticator he or she presses the "begin" button to "wake" the authenticator and initiate input for storage or comparison. Similarly, a "done" button may be provided so that users can finalize their entry.

The present invention is a temporary secure storage system for firearms. It is designed to provide convenient, secure storage of handguns. The system is ideally suited for persons who lawfully carry concealed weapons and seek to abide by local ordinances regarding gun-free areas. Rather than leave the weapon in a vehicle before entering a gun-fee zone, which is inherently insecure, the user can store the firearm at a facility having secure entry, and individually secured storage containers. Each storage container must be locked and opened by the same person, thereby reducing the likelihood that the customer's firearm will be stolen. In this manner the system provides convenience and peace of mind to gun-carrying persons.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A temporary secure storage system for firearms, comprising:

one or more facilities, having an interior storage area, a secure service area, and a service window enabling access therebetween, wherein entryways into said secure service area have automatic locks openable from inside said facility;

wherein said interior storage area is restricted to system administrators;

wherein said secure service area is accessible to customers upon entry to said one or more facilities;

a plurality of secure storage containers each having an interior volume accessible via a lid, and each of said storage containers having an electronic locking mechanism and an authenticator, wherein a first use of said authenticator engages said electronic locking mechanism, locking said storage container, and wherein a second use of said authenticator disengages said electronic locking mechanism, releasing said storage container;

wherein all of said storage containers are stored in said interior storage area and each of said storage containers is accessed in said secure service area;

a customer database;

a server;

a network.

2. The system of claim 1, wherein said secure service area is an enclosed drive-through bay.

3. The system of claim 2, wherein said drive-through bay comprises an entrance and an exit;

each of said entrance and said exit having locking doors;

a motion detection unit disposed at said entrance;

wherein said motion detection unit identifies a vehicle approaching said drive-through bay and signals retraction of said locking doors of said entrance;

wherein each of said locking doors of said entrance and said locking doors of said exit automatically close and lock when said vehicle enters said drive-through bay;

a button;

wherein said button signals release of said locking doors of said exit after a transaction is completed.

4. The system of claim 1, wherein said authenticator is a biometric scanner.

5. The system of claim 1, wherein said authenticator is a keypad.

6. The system of claim 1, wherein said authenticator is a card reader.

7. The system of claim 1, wherein said interior volume of each of said storage containers is padded and thermally insulated.

8. The system of claim 1, wherein said database stores customer information relating to state issued identification and local firearm permit numbers.

9. The system of claim 1, wherein specific customer information stored within said customer database is deleted upon retrieval of a firearm stored within one of said storage containers.

10. The system of claim 1, wherein access to said interior storage area is restricted via identity confirmation lock, such that only system administrators have access.

11. The system of claim 1, wherein said electronic locking mechanisms of said storage containers are in wireless communication with said customer database.

12. The system of claim 1, wherein said first use of said authenticator is stored within a storage media, and compared with said second use of said authenticator to unlock said storage container.

13. A method of restricting access to a firearm storage container, comprising the steps of:

entering a secure service area;

providing identification and firearm permits;

receiving a storage container;

placing a firearm within and closing said storage container;

entering a first instance of personal information into an authenticator of said storage container;

locking said storage container via an electronic locking mechanism;

retaining said first instance of personal information on a storage media contained within said electronic locking mechanism;

providing a second instance of personal information to said authenticator;

comparing said second instance of personal information with said first instance of personal information stored in said storage media contained within said electronic locking mechanism;

unlocking said storage container upon confirmation of a match between said first instance of personal information and said second instance of personal information;

removing a firearm from said storage container.

14. The method of claim 13, wherein said secure service area comprises an enclosed drive-through bay having doors in front of and behind a vehicle in said drive-through bay;

wherein said doors close and lock after a customer enters said drive-through bay;

wherein said doors open via a button after a transaction is completed.

* * * * *